United States Patent [19]

Kemp

[11] 4,430,831

[45] Feb. 14, 1984

[54] WINDOW BUCK AND FRAME

[75] Inventor: Melvin T. Kemp, Layton, Utah

[73] Assignee: Bowman & Kemp Steel & Supply, Inc., Ogden, Utah

[21] Appl. No.: 378,053

[22] Filed: May 14, 1982

[51] Int. Cl.[3] ..... E06B 1/04

[52] U.S. Cl. ..... 52/211; 52/127.3; 49/504; 249/39

[58] Field of Search ..... 52/204, 211, 213, 215, 52/577, 127; 249/39; 49/504, 463

[56] References Cited

U.S. PATENT DOCUMENTS

| | | | |
|---|---|---|---|
| 1,863,549 | 6/1932 | Lockwood | 249/39 X |
| 2,559,656 | 7/1951 | Okazaki | 52/215 X |
| 2,787,820 | 4/1957 | Shields et al. | 249/39 X |
| 2,893,235 | 7/1959 | Goldberg | 52/213 |
| 2,901,810 | 9/1959 | Richards | 249/39 |
| 3,092,887 | 6/1963 | Switzer | 249/39 |
| 3,367,618 | 2/1968 | Masur | 249/39 |
| 3,439,894 | 4/1969 | Haider | 249/39 |
| 3,768,220 | 10/1973 | Riegelman | 52/211 X |
| 3,835,586 | 9/1974 | Gates | 52/215 X |
| 3,995,843 | 12/1976 | Kasteler | 249/39 |
| 4,138,084 | 2/1979 | Reid | 249/39 X |

FOREIGN PATENT DOCUMENTS

| | | | |
|---|---|---|---|
| 491462 | 3/1953 | Canada | 249/39 |
| 631564 | 11/1961 | Canada | 249/39 |

*Primary Examiner*—J. Karl Bell

*Attorney, Agent, or Firm*—Terry M. Crellin

[57] ABSTRACT

A nonbracing self-framing window buck frame or surround for forming a framed window opening in a cast concrete wall or the like. The buck frame or surround comprises a support frame made of channel members arranged end-to-end to form a substantially rectangular framework. A window frame is fit within the framework formed by the channel members, such that a peripheral mounting flange on the window frame abuts one side of the framework. A frame structure adapted to receive nails or other fasteners abuts the peripheral mounting flange of the window frame, and means are provided for securing the support frame and frame structure together, with the peripheral mounting flange on the window frame being held securely between the frame structure and the support frame. The buck frame or surround, including the self-contained window frame, is positioned between wall forms, and concrete is poured around the buck frame or surround. After the concrete has cured, the forms are removed. The buck frame or surround remains in the concrete wall, forming a self-framed window opening having a sturdy, finished exterior casing and an interior framing structure to which interior wallboard and other window sash and trim can be readily attached.

12 Claims, 4 Drawing Figures

WINDOW BUCK AND FRAME

BACKGROUND OF THE INVENTION

1. Field

The present invention relates to window bucks or surrounds for forming a window opening in poured concrete walls.

2. State of the Art

In pouring window walls such as basement walls, window openings are commonly formed in the concrete walls as the walls are poured. It was common in the past to construct wooden windows openings as a part of the wood forms for the concrete walls. After the poured concrete had set, the wood forms including the wooden window portions were removed and at least the wooden window portions of the forms had to be discarded. The cost of the wood forms which are not reusable, and the labor required in building the forms with integral wooden window forms were distinct disadvantages of this type construction.

To avoid the disadvantages of constructing wooden window opening forms within the wall forms, two general methods have been proposed. The first of these methods is to provide reusable metal buck forms which are positioned between the spaced walls of the concrete wall forms. The buck forms are commonly made in two parts or are bevel shapped such that when the concrete which has been poured around the buck form has set, the buck form can be removed from the opening formed in the resulting concrete wall. A window frame can be detachably secured to the buck frame such that the window frame is cast in and remains in the opening when the concrete sets and the removable buck is removed. For example, see U.S. Pat. No. 3,092,887. Alternatively, the removable buck form can be shaped or made of two parts such that a mounting ledge or step is formed in the concrete to which a window frame can be mounted after the concrete has set and the removable buck has been removed. For example, see U.S. Pat. Nos. 4,138,048 and 3,439,894. When reusing the removable buck forms, the forms must be cleaned and oiled or otherwise prepared for reuse. The costs of preparing the metal buck forms for reuse is substantial, and, further, the buck forms can only be used a limited number of times due to the rather rough handling they receive during the installation in the concrete forms, and the pouring of concrete and the removal thereof from the set concrete wall.

The second general method which has been proposed to avoid the in situ construction of wooden window opening forms within the wall forms, employs a metal buck frame or surround which is positioned between the spaced walls of the concrete wall forms. Concrete is poured around the buck form or surround, and when the concrete has set, the wall forms are removed, leaving the buck form or surround in place to form the periphery of the window opening. For example, see U.S. Pat. No. 2,893,235. These buck forms or surrounds have been found to be subject to being deformed during the pouring of concrete thereabout as the wall is being formed unless reinforcement or support is provided for the buck frame or surround. For example, see U.S. Pat. No. 3,995,843 which discusses the problem and discloses a particular, reusable brace to be used to at least reduce the severity of the problem.

3. Objectives

It is a principal objective of the present invention to provide a nonbracing, self-framing window buck and frame which is constructed as an integral unit comprising inner and outer rectilinear frame members adapted to be secured together so as to firmly hold a window frame in position between the frame members, whereby the buck frame unit is readily mounted between the spaced walls of concrete wall forms and is designed to remain permanently in place after the concrete wall has been poured and the wall forms removed, with the outer frame member of the unit ultimately forming an outer protective casing for the window opening in the concrete wall and with the inner frame member forming a nailing frame for attachment of wallboard and other window sash and trim used in finishing the interior of the concrete wall. An additional objective of the invention is to provide a relatively inexpensive window frame and buck unit which is shipped, handled and installed as a single unit, which produces an attractive, sturdy, well finished window opening, and which virtually eliminates warping or deforming of the buck frame or window frame during the pouring of the concrete wall.

SUMMARY OF THE INVENTION

The above objectives are achieved in accordance with the invention by providing a novel, unique, nonbracing, self-framing window buck and frame for forming a framed window opening in a cast concrete wall or the like. Principal features of the window buck and frame of the present invention include an outer support frame made of four elongate channel members which have a substantially U-shaped cross section. The channel members are attached together in substantially end-to-end arrangement to form the periphery of a framework circumscribing a substantially rectangular window opening, with the base of the channel members facing the opening and with the legs of the channel members extending outwardly from the opening.

A window frame, such as of conventional aluminum window construction, having a peripheral mounting flange therearound, is fit within the inner support frame so that the peripheral mounting flange abuts the outside face of the legs of the channel members of the support frame at one side of the support frame.

Four elongate rigid members, preferably made of wood, are attached together in substantially end-to-end arrangement to form a substantially rectangular, wood frame structure having essentially the same shape and size as the support frame. The wood frame structure is adapted to abut, along one of its rectangular side edge faces, the peripheral mounting flange of the window frame, with the peripheral mounting flange being sandwiched between the wood frame and the support frame. Means are provided for firmly connecting the wood frame to the support frame, such that the wood frame and the support frame are in substantial registry with each other, and the peripheral mounting flange on the window frame is held securely between the wood frame and the support frame.

The window buck and frame of this invention is thus constructed as a single, unified item or unit. The unit is shipped, handled, and installed in the wall forms for a concrete wall as a single unit. The unit is easily and quickly installed between the wall forms of the concrete forms. As will be more fully described hereinafter, the outside legs of the channel members of the support frame are preferably provided with holes or apertures spaced therealong. After the outside wall form of the concrete was has been erected, the window buck and frame of this invention is positioned in place with the outside legs of the channel members of the support frame contacting the outside wooden wall form, and fasteners such as nails or screws are attached to the wooden wall form through the holes or apertures in the legs of the channel members, thereby firmly attaching the window buck and frame to the outside wall form. The inside wall form is then erected, and its inside surface will contact the edge faces of the wood frame of the window buck and frame inasmuch as the dimensions of the wood frame and the support frame of the window buck and frame are chosen such that the thickness of the window buck and frame is the same as the thickness of the concrete wall which is to be poured. The inside wall form is attached by nails or screws to the wood frame of the window buck and the window buck, being attached to both the outside and inside walls of the concrete forms, is securely held in place during pouring of concrete in the wall forms.

The window buck of the present invention is extremely sturdy and needs no bracing or other internal support. The sides of the buck are sturdy and firm, and there is no problem with distortion or crushing of the window buck due to the pressures exerted thereon by the concrete which is poured therearound.

When the wall forms are removed from the concrete wall, the window buck forms a self-framed window opening in the wall. The window frame is held securely in proper position within the opening. The channels of the support frame form an outer protective casing and an attractive outside finish for the window opening. The inner wood frame is flush with the inside face of the concrete wall and forms a nailing frame for attachment of wallboard and other window sash and trim used in finishing the interior of the concrete wall.

Additional objects and features of the present invention will become apparent from the following detailed description, taken together with the accompanying drawings.

THE DRAWINGS

Preferred embodiments of the present invention representing the best mode presently contemplated of carrying out the invention is illustrated in the accompanying drawings, in which.

Figure 1:
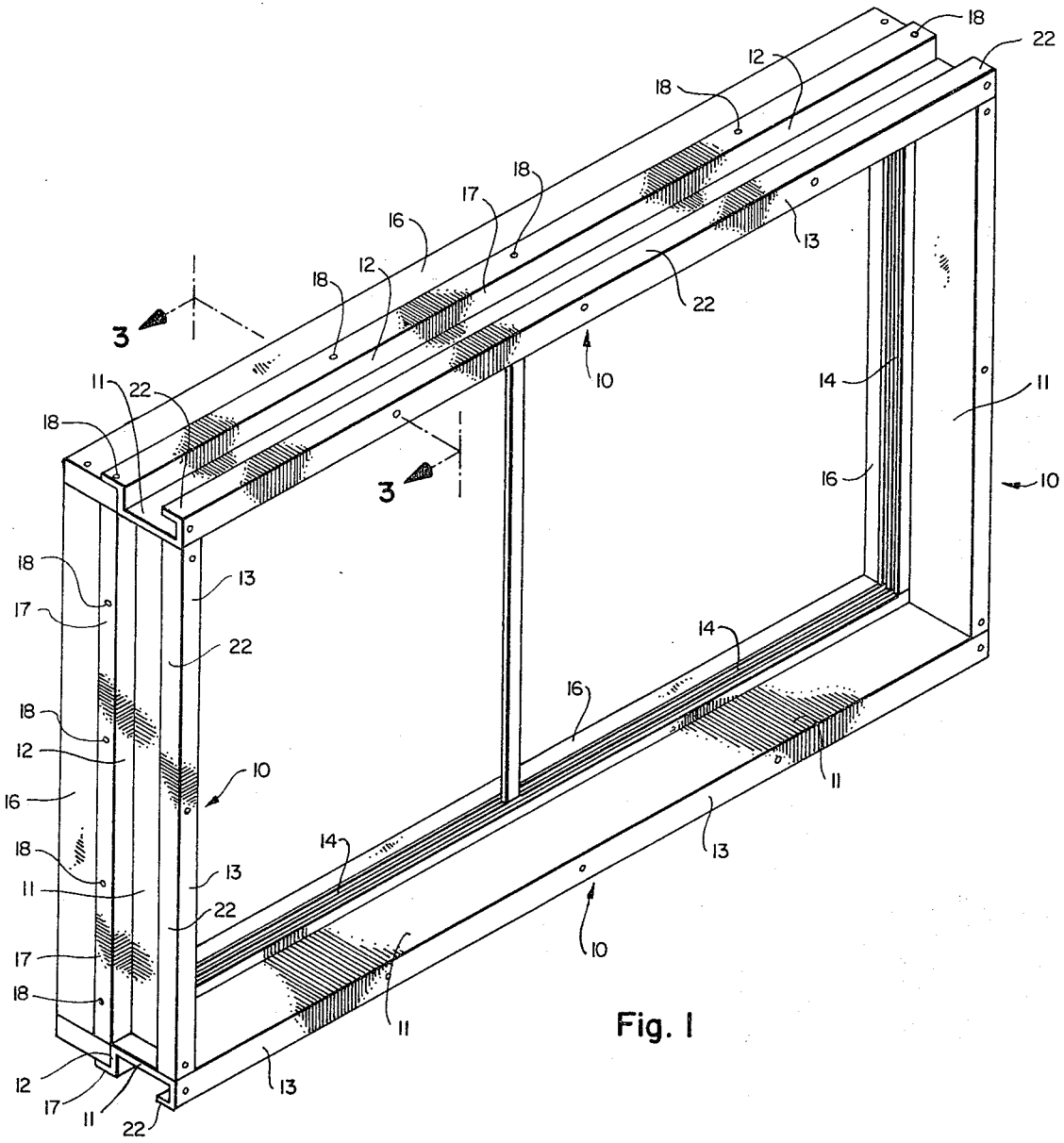
FIG. 1 is a pictorial taken from the outer or front and one side of a window buck and frame in accordance with the present invention.
Figure 2:
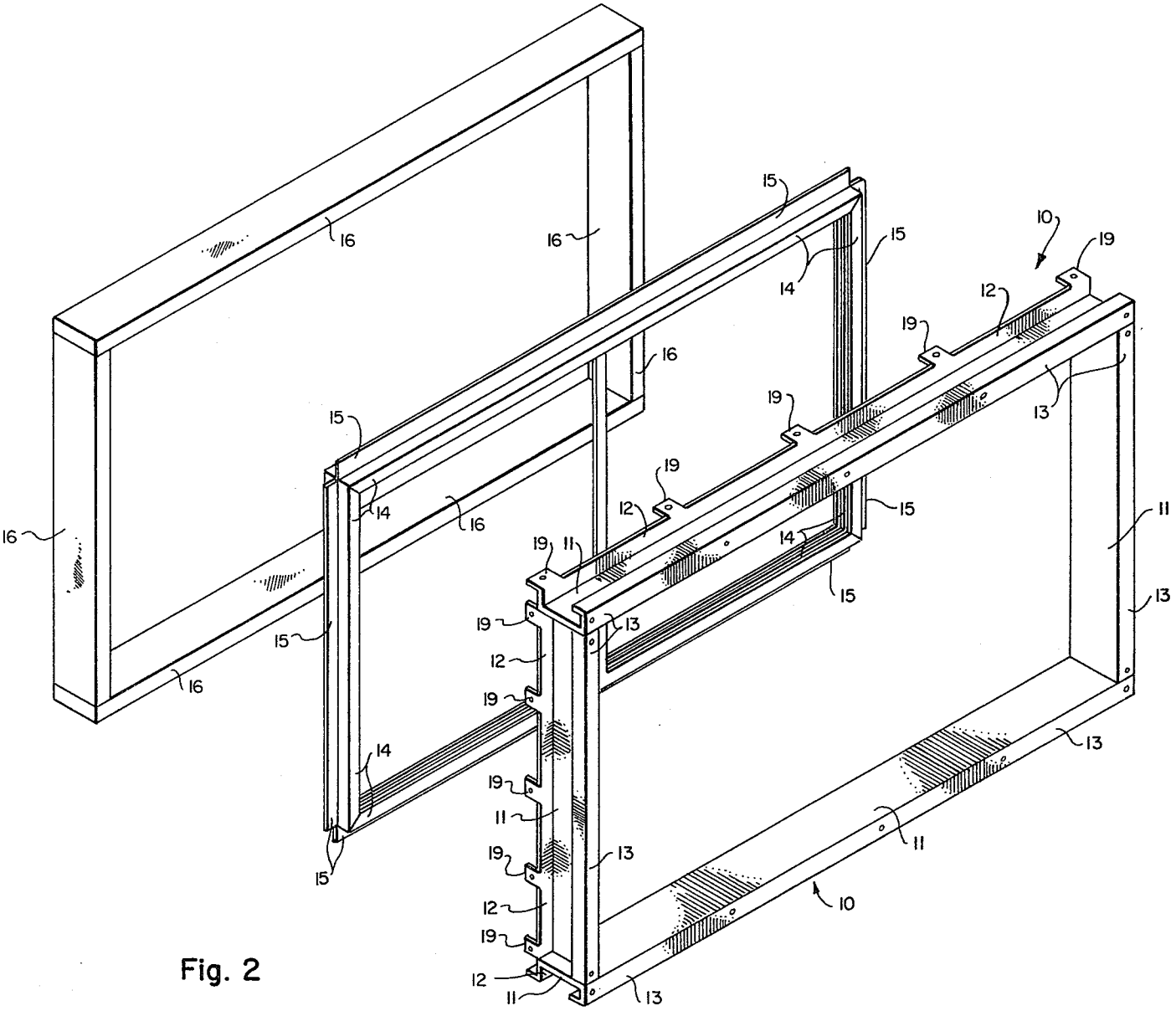
FIG. 2 is an exploded pictorial of a window buck and frame similar to that of FIG. 1, but showing an alternative means for connecting the inner and outer frames of the window buck.
Figure 3:
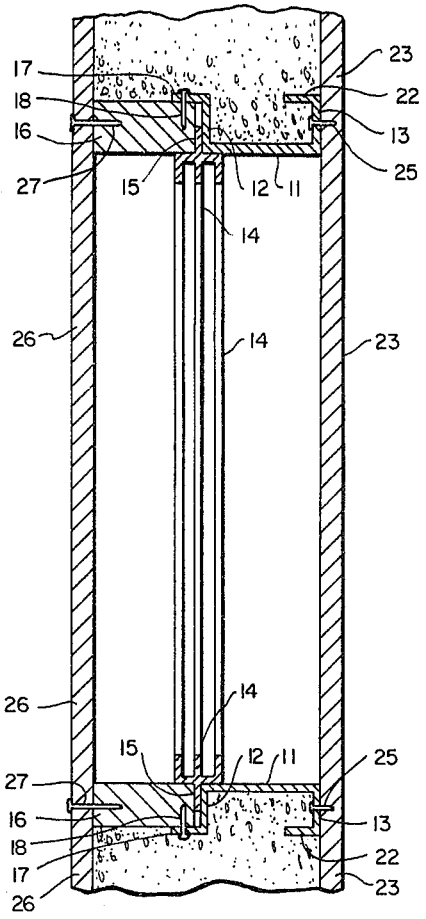
Figure 4:
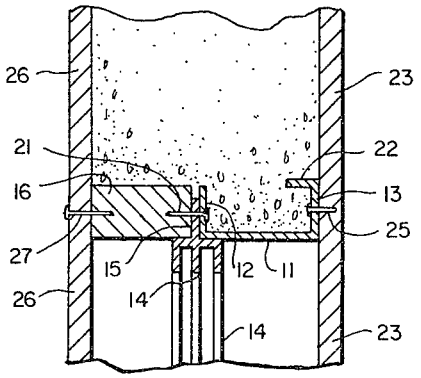

FIG. 3 is a vertical cross section of a window buck and frame similar to those of FIGS. 1 and 2, with the view taken along line 3—3 of FIG. 1 or through one of the tabs of FIG. 2, with the window buck and frame set in concrete and with wall forms in place; and FIG. 4 is a partial cross-section through the header of a window buck and frame similar to those of FIGS. 1–3 but showing a further alternative for connecting the inner and outer frames of the window buck, with the window buck and frame set in concrete and with wall forms in place.

DETAILED DESCRIPTION OF THE PREFERRED EMBODIMENTS

A preferred general embodiment of the window buck and frame of this invention is shown in the drawings, with particular alternative embodiments of means for connecting the inner and outer frames of the window buck being illustrated in FIGS. 1, 2 and 4.

As shown, the window buck and frame comprises four elongate rigid channel members 10 which are attached together in substantially end-to-end arrangement to form the periphery of a framework circumscribing a substantially rectangular opening. The channel members 10 have a substantially flat base 11, with first and second legs 12 and 13, respectively, extending from mutually respective longitudinal side edges of the base 11, so that the channel members 10 have a substantially U-shaped cross section. The channel members 10 are arranged and attached together in the framework in such a manner that the flat base portion 11 faces the opening circumscribed by the framework, and the legs 12 and 13 extend outwardly from the opening. As used throughout the specification and claims, the width of the legs 12 and 13 will be meant to refer to the depth or distance that the legs extend in a perpendicular direction from the flat base 11. The channel members 10 are preferably made of metal and in particular steel. However, it is to be understood that channel members could also be made of other materials such as fiberglass reinforced polymeric materials. When made of metal, the channel members are joined at their mutually respective ends, at the corners of the framework, by welding the ends to one another.

A window frame 14 is provided, with the window frame 14 being adopted to fit within the opening defined by the interior periphery of the framework formed by the channel members 10. The window frame 14 has a peripheral mounting flange 15 which extends outwardly, substantially perpendicularly from the outer perimeter of the window frame 14 proper. The window frame 14 advantageously comprises aluminum window frames as are common in the building industry. Such frames usually comprise extruded aluminum sides having multiple tracks or channels for mounting of window units and sliding of at least one of the window units within its associated track or channel in the frame. However, the present invention is not to be limited to the use of such aluminum window frames. The only criteria for the window frame in accordance with this invention is that the window frame proper is adapted to fit within the opening circumscribed by the framework comprising the channel members 10, and that the window frame has a peripheral mounting flange 15 as described above. As used throughout the specification and claims, the width of the peripheral mounting flange 15 will be meant to refer to the depth or distance that the flange 15 extends in a perpendicular direction from the periphery of the window frame 14 proper. The peripheral mounting flange 15 is adapted to abut the outside face of mutually respective first legs 12 of the channel members 10 along one side of the framework formed by the channel members 10 when the window frame 14 is in its proper position within the opening defined by the framework.

Four elongate rigid members 16 are attached together in substantially end-to-end arrangement to form a substantially rectangular frame structure. The rigid members 16 can be made of any material which is susceptible to receiving nails or other fasteners in a manner similar to wood. For example, the rigid members 16 could be made of pressed fiber material or of polymeric material especially foamed polymerics which exhibit rigid characteristics while still having the ability to have nails or other fasteners such as screws driven thereinto. In the preferred embodiment of the invention, the rigid members 16 are made of wood.

The frame structure has an inside dimension corresponding to the opening circumsribed by the framework formed by the channel members 10. The frame structure is thus adapted to circumscribe the window frame 14 and to abut, along one of its rectangular, side edge faces, the peripheral mounting flange 15 on the window frame 14. When the rigid members 16 are made of wood, they are preferably made of wood which is resistant to wet, damp environments, such as redwood, etc., or from wood which has been pressure treated as is well known in the construction industry for use in conjunction with concrete or in wet damp environments. The pressure treated wood is resistant to rot, decay, termites, etc. The wood members 16 are preferably two-by-fours which have been attached together at their mutually respective ends, such as by being nailed together.

Means are then provided for firmly connecting or attaching the first legs 12 of the channel members 10, at least at spaced intervals therealong, to the respective rigid members 16 of the frame structure, with the frame structure and the framework being in substantial registry with each other. The attachment or connection of the legs 12 to the rigid members 16 is such that the peripheral mounting flange 15 of the window frame 14 is held securely between the frame structure and the framework. There results a unitary window buck and frame as shown in FIG. 1 which is shipped and handled as a single unitary article which is quickly and easily installed between the wall forms for a concrete wall.

In the preferred illustrated embodiments, the first legs 12 of the channel members 10, which are, of course, located along one side of the framework formed by the channel members 10, have widths which are at least the width of the peripheral mounting flange 15 on the window frame 14. The wood members 16 of the wood frame structure have a width or thickness abutting the peripheral mounting flange 15 substantially the same as the widths of the mutually respective first legs 12 of the channel members 10. Inasmuch as the mounting flanges 15 of commercially available window frames 14 are no greater than the thickness of a finished two-by-four, i.e., about 1.5 to 1.75 inches, it has been found particularly advantageous and, thus, preferred, to use two-by-four members as the wood members 16 and to make the width of all the first legs 12 of the channel members 10 of uniform thickness, with the thickness being essentially that of the thickness of a finished two-by-four board.

As illustrated in FIGS. 1 and 3, one preferred mode of attaching or connecting the legs 12 to the wood frame structure comprises substantially flat lips 17 integrally attached to the outwardly extending edges of the respective legs 12 of the channel members 10. In the preferred embodiment, the channel members 10 are made from metal plate which has been formed into proper shape, and the lips 17 are extensions of the legs 12 which have been bent back substantially perpendicular to the legs 12. The lip 17 could also be a separate, elongate, relatively narrow, metal slat or bar which has been integrally secured to the edge of the leg 12 by welding the slot or bar to the edge of the leg 12 at least at a plurality of places along the length of the slat or bar and the leg 12. If the channel members 10 are made of a plastic material, it is preferable to form the lip 17 integrally with the leg 12, such as when the channel member 10 is being molded or otherwise formed.

The flat lips 17 extend substantially perpendicularly from the legs 12 so as to lie substantially flatwise against the outer perimeter of respective wood members 16 of the wood frame structure. Means are provided for securing the flat lips 17 to the wood members 16. As illustrated in FIGS. 1 and 3, openings are spaced along the flat lips 17, with the openings being adapted to receive fasteners for attaching the flat lips 17 to the wood members 16. As shown, nails 18 are driven through the openings into the wood members 16. Screws could also be used in place of the nails.

In a somewhat modified embodiment as illustrated in FIG. 2, the lip has been replaced by attachment tabs 19 spaced along and integrally attached to the edges of the legs 12. The attachment tabs 19 extend substantially perpendicular from the legs 12 so as to lie substantially flatwise against the outer perimeter of the respective wood members 16 of the wood frame structure. The tabs 19 can be integrally formed on the channel members 10 during stamping and bending thereof, or the tabs 19 can be welded to the legs 12. As with the lip 17 of FIGS. 1 and 3, the tabs 19 are adapted to receive fasteners for attaching the tabs 19 firmly to the wood members 16. As shown, wood nails 20 are driven through the openings into the wood members 16. Screws could also be used in place of the nails.

A somewhat less preferred alternate embodiment of means for attaching the legs 12 to the wood members 16 is shown in FIG. 4. In this embodiment opening are spaced along the legs 12 of the channel members. The openings are adapted to receive fasteners such as nails or screws for attaching the legs 12 to the wood members 16. As shown, nails 21 are driven through the openings and the mounting flange 15 of the window frame 14 into the wood members 16.

In a preferred embodiment of the window buck and frame as illustrated, edge flanges 22 are provided along the projecting edges of the second legs 13 of the channel members 10. The edge flanges 22 are preferably integrally attached to the projecting edges of the second legs 13 and extend generally backwardly toward the first legs 12 of the channel members 10. Advantageously, the edge flanges 22 are formed during forming of the channel members 10 by bending the otherwise free edge portions of legs 13 backwardly toward the first legs 12 and preferably substantially parallel to the flat base 11. The width of the edge flanges 22 is not critical per se, but is preferably within the range of about $\frac{1}{4}$ to 1 inch. The edge flanges 22 provide dimensional stability for the legs 13, and strength for the channel members 10. In addition, the in turned edge flanges 22 are imbedded in the finished concrete walls so as to securely hold the channel members 10 to the concrete walls and to provide an attractive outside finish to the window opening.

Means are preferably provided for attaching the window buck and frame of this invention to the inside face of the outer concrete wall form 23 after the outer wall form 23 has been erected. As illustrated, the second legs 13 of the channel members 10 are provided with apertures 24 (FIGS. 1 and 2) spaced therealong. The apertures 24 are adapted to receive fasteners, such as nails or screws, for attaching the window buck and frame to the outer wall form 23. As shown in FIGS. 3 and 4, nails 25 are driven through the apertures and into the outer wall form 23. The inner wall form 26 (FIGS. 3 and 4) is then erected, and as explained hereinabove, fasteners, such as nails or screws are driven through the wall form 26 into the wood members 16 of the window buck and frame so as to secure the window buck and frame securely between the wall forms 23 and 26. As shown, nails 27 are driven through the wall form 26 into the wood members 16. Concrete 28 (FIGS. 3 and 4) is then poured around the window buck and frame, and after the concrete has cured, the wall forms 23 and 26 are removed. The ends of nails 25 extending from the outer face of the legs 13 are clipped off adjacent to the legs 13. The resulting window opening has a finished casing comprising the channel members 10 to the outside of the concrete wall and a nailing frame flush with the inside face of the concrete wall. The window frame 14 is held securely in place between the nailing frame and the outside casing comprising the channel members 10.

As can be seen from FIGS. 3 and 4, if for any reason, the window frame 14 is subsequently damaged or for any other purpose requires replacement, the nailing frame can be pried from the concrete wall. The old frame 14 can then be removed and replaced with a new frame without disrupting the concrete wall or the outer metal casing of the window opening. After the new casing has been positioned within the opening a new nailing frame can be provided by adhesively attaching new members to the otherwise exposed concrete of the window opening.

Although preferred embodiments of the window buck and frame apparatus have been illustrated and described, it is to be understood that the present disclosure is made by way of example and that various other embodiments are possible without departing from the subject matter coming within the scope of the following claims, which subject matter is regarded as the invention.

I claim:

1. A nonbracing, self-framing window buck and frame for forming a framed window opening in a cast concrete wall or the like, said window buck and frame comprising four elongate, rigid channel members, each of said channel members comprising a substantially flat base, with first and second legs extending from mutually respective longitudinal side edges of said base, so that said channel members have a substantially U-shaped cross section, said channel members further being attached together in substantially end-to-end arrangement to form the periphery of a framework circumscribing a substantially rectangular opening, with the flat base of said channel members facing said opening and with the legs of said channel members extending outwardly from said opening;

a window frame adapted to fit within said opening, said window frame having a peripheral mounting flange which is adapted to abut the outside face of mutually respective flat legs of said channel members at one side of said framework;

four elongate members attached together in substantially end-to-end arrangement to form a substantially rectangular, frame structure, said frame structure being adapted to abut, along one of its rectangular, side edge faces, the peripheral mounting flange of said window frame; and means for firmly connecting said first legs of said channel members at least at spaced intervals therealong, to said frame structure, such that said frame structure and said framework are in substantial registry with each other, with said peripheral mounting flange on said window frame held securely between said frame structure and said framework.

2. A window buck and frame as claimed in claim 1, wherein the first legs of said channel members at said one side of said framework have widths at least the width of the peripheral mounting flange on said window frame, the members of said frame structure have a thickness abutting said peripheral mounting flange substantially the same as the widths of the mutually respective first legs of the channel members, and the means for connecting said first legs at said one side of said framework to said frame structure comprises spaced apart attachment tabs integrally attached at mutually respective ends to the outwardly extending edges of said first legs, said attachment tabs extending substantially perpendicular from said first legs so as to lie substantially flatwise against the outside perimeter of respective members of said frame structure, and means are provided for securing said attachment tabs to said members of said frame structure.

3. A window buck frame as claimed in claim 2, wherein the means for securing the attachment tabs to the members of said frame structure comprises openings in said attachment tabs, said openings being adapted to receive fasteners for attaching said attachment tabs to said members of said frame structure.

4. A window buck frame as claimed in claim 1, wherein the first legs of said channel members at said one side of said framework have widths at least the width of the peripheral mounting flange on said window frame, the members of said window frame structure have a thickness abutting said peripheral mounting flange substantially the same as the widths of the mutually respective first legs of the channel members, and the means for connecting said first legs at said one side of said framework to said frame structure comprises substantially flat lips integrally attached to the outwardly extending edges of the respective first legs of said channel members, said flap lips extending substantially perpendicularly from said first legs so as to lie substantially flatwise against the outer perimeter of respective members of said frame structure, and means are provided for securing said flat lips to said members of said frame structure.

5. A window buck frame as claimed in claim 4, wherein the means for securing the flat lips to the members of said frame structure comprises openings spaced along said flat lips, said openings being adapted to receive fasteners for attaching said flat lips to said members of said frame structure.

6. A window buck and frame as claimed in claim 1, wherein the means for connecting the first legs of said channel members to said frame structure comprises opening spaced along said first legs, said openings being adapted to receive fasteners for attaching said first legs to said frame structure.

7. A window buck and frame as claimed in claim 1, wherein the second legs of said channel members are provided with apertures spaced therealong, said apertures being adapted to receive fasteners for attaching the window buck and frame to the inside face of a concrete wall form.

8. A window buck and frame as claimed in claim 1, wherein edge flanges are provided along the projecting edges of the second legs of said channel members, with said edge flanges being integrally attached to the projecting edges of said second legs and extending therefrom generally backwardly toward said first legs of said channel members.

9. A window buck and frame as claimed in claim 1 wherein the channel members are made of metal plate stock which has been formed into the proper shape of the channel members.

10. A window buck and frame as claimed in claim 9, wherein the channel members are welded together at their mutually respective ends.

11. A window buck and frame as claimed in claim 1, wherein the rigid members of said frame structure are made of wood and are nailed together at their mutually respective ends.

12. A window buck and frame as claimed in claim 1, wherein the wood members have been pressure treated for use in conjunction with concrete.

* * * * *